US009440244B2

(12) United States Patent
Schmidt et al.

(10) Patent No.: US 9,440,244 B2
(45) Date of Patent: Sep. 13, 2016

(54) FIBER REINFORCED POROUS METAL CENTRIFUGE ROTOR

(75) Inventors: Matthias Schmidt, Brehna (DE); Steffen Arnold, Leipzig (DE); Fritz Peter Schulze, Leipzig (DE); Rajko Bittner, Elstertrebnitz (DE); Stefan Boenisch, Leipzig (DE)

(73) Assignee: EPPENDORF AG, Hamburg (DE)

( * ) Notice: Subject to any disclaimer, the term of this patent is extended or adjusted under 35 U.S.C. 154(b) by 757 days.

(21) Appl. No.: 13/546,245

(22) Filed: Jul. 11, 2012

(65) Prior Publication Data

US 2013/0023398 A1 Jan. 24, 2013

Related U.S. Application Data

(60) Provisional application No. 61/572,167, filed on Jul. 12, 2011.

(51) Int. Cl.
*B04B 7/08* (2006.01)
*B04B 5/04* (2006.01)

(52) U.S. Cl.
CPC ..... *B04B 7/085* (2013.01); *B04B 5/0414* (2013.01)

(58) Field of Classification Search
CPC ..... B04B 5/0414; B04B 2007/025; B04B 7/085
USPC ..... 494/16, 20, 33, 34, 37, 60, 63, 81, 85; 422/72
See application file for complete search history.

(56) References Cited

U.S. PATENT DOCUMENTS

| | | | | |
|---|---|---|---|---|
| 3,494,292 | A * | 2/1970 | Walker et al. | 415/110 |
| 4,824,429 | A * | 4/1989 | Keunen | B04B 5/0414 494/16 |
| 5,411,465 | A * | 5/1995 | Glen et al. | 494/16 |
| 6,517,475 | B1 * | 2/2003 | Brown | B04B 1/04 123/196 A |
| 2003/0153981 | A1 * | 8/2003 | Wang et al. | 623/22.21 |
| 2006/0222504 | A1 * | 10/2006 | Reigl | 416/241 R |
| 2010/0313751 | A1 * | 12/2010 | Hassan | B01D 53/22 95/45 |

FOREIGN PATENT DOCUMENTS

| | | |
|---|---|---|
| DE | 37 84 163 T2 | 2/1993 |
| DE | 10 2006 022 164 A1 | 11/2007 |
| DE | 102 33 536 A1 | 1/2010 |

* cited by examiner

*Primary Examiner* — Charles Cooley
*Assistant Examiner* — Shuyi S Liu
(74) *Attorney, Agent, or Firm* — Von Rohrscheidt Patents

(57) ABSTRACT

The present invention relates to a centrifuge rotor, in particular a laboratory centrifuge rotor, including a rotor body, wherein the rotor body at least partially includes a porous metal or a porous metal alloy and an armoring located radially outside with respect to the rotation axis of the rotor body is provided.

18 Claims, 5 Drawing Sheets

FIBER REINFORCED POROUS METAL CENTRIFUGE ROTOR

RELATED APPLICATIONS

This application claims priority from and incorporates by reference U.S. Provisional Patent Application 61/572,167 filed on Jul. 12, 2011.

FIELD OF THE INVENTION

The present invention relates to centrifuge rotors, in particular for laboratory and industrial centrifuges according to the preamble of claim 1.

BACKGROUND OF THE INVENTION

Such centrifuges are used for separating the constituents in heterogeneous systems, wherein the effectiveness and efficiency of the centrifugation essentially depends on the rotational speed of the centrifuge rotors. Therefore, an increase of the rotational speed of such centrifuges is constantly aspired. However, an increase of the rotational speed entails an increased load acting on the centrifuge rotors for which reason centrifuge rotors are normally made of high-strength materials, such as steel, titanium and aluminum, but the use of fiber composites is also known from DE 102 33 536 A1, for example.

Although such centrifuge rotors made of fiber composites have lower weight compared with the rotors made of metal, the weight of these rotors is still that high that an essential increase of the maximum rotational speed is not attained.

BRIEF SUMMARY OF THE INVENTION

It is therefore an object of the present invention to provide a centrifuge rotor which allows considerably higher rotational speeds to be attained, wherein in particular at least the mechanical properties of commonly used aluminum rotors are to be attained.

This object is achieved with a centrifuge rotor including a circular one piece rotor body at least partially including a porous metal or a porous metal alloy; and at least one armoring that is arranged at the circular one piece rotor body on a radial outside of the circular one piece rotor body with reference to a rotation axis of the circular one piece rotor body, wherein the centrifuge rotor includes a hub arranged at the rotor body wherein the hub is fixated in the rotor body through annular foam encasement, wherein the foam forms an annular region around an entire circumference of the hub, wherein the annular re ion extends over an entire axial extension of the hub. Advantageous embodiments are defined in the dependent claims.

The inventors have found that the use of a porous metal or a porous metal alloy in conjunction with a radially outer armoring results, due to a combinatorial effect, in centrifugal rotors which have an essentially lower mass along with an increased stiffness as compared with conventional centrifuge rotors. The reduction of mass is attained by using the porous metal and/or the porous metal alloy and the armoring leads to such a stiffening of the porous material that the centrifuge rotor is capable of resisting even highest loads. These centrifuge rotors according to the present invention allow a reduction of the centrifugation time and/or an improvement of the centrifugation result to be attained due to the higher rotational speeds achieved in centrifugation.

In the context of the present invention, "radially outer" means that at least in a section of the rotational axis an armoring is vertically arranged with respect to the rotational axis at the circumference of the rotor body. This armoring need not be provided completely over the overall axial extension of the circumference, partial axial arrangement of the armoring over the circumference is sufficient. Although in the case of partial armoring over the axial circumference it is advantageous that the armoring is provided in portions of the rotor body spaced radially farthest from the rotational axis, the armoring may alternatively be arranged in portions of the rotor body located farther inside. Preferably, the armoring is of ring-shaped configuration, and one or a plurality of rings may be provided.

In an advantageous embodiment, the porous metal or the porous metal alloy is a foam material. In this case, the porous material can be produced by a powder- or melt-metallurgical process, for example, in particular by introducing a gas into the interior of a metal, whereby bubbles are produced which are surrounded by a metal membrane ensuring the strength of the porous material.

Advantageously, the metal or the metal alloy comprises at least one component selected from the group of aluminum, iron, copper, magnesium, nickel, titanium or alloys thereof or brass since centrifuge rotors made from these materials have a high strength even if the materials are porous. The alloys may include one or a plurality of the aforementioned components. The advantageous components are aluminum, magnesium and titanium.

According to a particularly advantageous aspect, the armoring includes a fiber-reinforced material, wherein the fibers preferably include at least one material selected from the group of carbon fibers, mineral fibers, ceramic fibers or plastic fibers or mixtures of the aforementioned materials. Advantageously, a fiber-reinforced plastic material is used as an armoring material, e.g. a carbon fiber-reinforced plastic material in the form of a carbon roving which is embedded in epoxy resin. The fibers may generally be provided in other configurations, e.g. as non-woven fabric, woven fabric or the like. Preferably, for cross-linkage purposes all commercially available duromer systems may be used, i.e. besides epoxy resins also phenolic resins and the like.

According to a particularly advantageous aspect, the armoring is arranged in a recess, preferably in a groove provided in the rotor body since this allows the armoring to be particularly reliably connected with the rotor body. Alternatively or additionally, the armoring may have a larger radial width (thickness) in at least one portion of the rotor body located radially farther outside than in a portion located radially farther inside. Thus centrifugal forces acting upon the centrifuge rotor can be particularly effectively absorbed by the armoring without the weight of the centrifuge rotor being unnecessarily increased. Preferably, the armoring is arranged at the rotor body by a substance-to-substance connection or a positive connection, thus, when the armoring is glued in a recess of the rotor body, simultaneously by a substance-to-substance connection and a positive connection, which ensures a very strong and durable connection.

In a advantageous further embodiment, the centrifuge rotor includes a hub arranged at the rotor body, which hub preferably includes a non-porous metal or a non-porous metal alloy. Since the hub is thus a part independent of the rotor body and the centrifuge rotor is of multi-part configuration, it is ensured that the rotor body itself must not absorb the torques occurring during acceleration or deceleration of the centrifuge rotor but these torques are imparted to the rotor body via the hub.

In this regard it is appropriate that the hub is foamed in place in the rotor body and/or is detachably fastened, e.g. screwed, to the rotor body, which ensures a particularly durable and stable connection between rotor body and hub. This connection can be enhanced by positive-connection elements provided at the hub which preferably extend axially, such as webs and the like. Further, a plurality of positive-connection elements protruding in a pin-like manner may also be provided.

According to an particularly advantageous aspect, the hub is of conical configuration. The resultant conical connection between hub and rotor body leads to a particularly good stress distribution at the transition between hub and rotor body. In hubs with a spline profile high stress peaks occur at the edges, which stress peaks are prevented in a conical design. This conical design further has a self-centering effect during the process of joining hub and rotor body, whereby potential imbalances which may occur due to an eccentric position of the hub in the rotor body are more efficiently prevented during the joining process. Direct foaming in place of the hub results in a better foam distribution as compared to an offset hub shape.

If the hub is directly foamed in place, care must be taken that its melting point is sufficiently high such that it does not melt or soften when being foamed in place.

In a particularly advantageous aspect, the porous metal or the porous metal alloy has a pore size from 10 μm to 500 μm, preferably from 100 μm to 500 μm, in particular 250 μm. In these ranges the material offers an optimum of weight and stiffness even at very high rotational speeds of the centrifuge rotor. Preferably, the pores are of spherical configuration.

Further, advantageously the centrifuge space is sealed against gas, liquid and/or aerosol. In particular, it is intended that the centrifuge rotor is provided with closed pores in the direction of the centrifuge space. The pores can be closed either during production of the porous material or subsequently by applying a sealing material. In a particularly advantageous aspect, the rotor body is provided with a surface sealing material (e.g. from Teflon®, a registered Trademark of E.I. du Pont de Nemours and Company or the like) resistant to temperature and chemicals. Receiving sections for the samples to be centrifuged, should they be subsequently milled, for example, into the centrifuge rotor, should also be provided with a pore sealing material, wherein preferably prefabricated sleeves are arranged, in particular glued, in the receiving bores.

Further, according to an advantageous aspect, the armoring essentially completely encloses the circumference of the rotor body. In this regard, "essentially" means that, when a recess for receiving the armoring is provided in the rotor body, for example, the webs of the rotor body protruding at the edge of the recess are not enclosed by the armoring.

Further, a contour ring for a positive connection with a centrifuge lid is advantageously arranged at the rotor body, wherein the contour ring is configured as a separate element having a higher strength than the porous metal or the porous metal alloy. This separate contour ring ensures that the centrifuge space is closed and sealed tight by a centrifuge lid and simultaneously relieves the rotor body from the strain applied by the centrifuge lid.

BRIEF DESCRIPTION OF THE DRAWINGS

The features of the present invention and further advantages are described based on advantageous embodiments with reference to drawing figures, wherein.

DETAILED DESCRIPTION OF THE INVENTION

Figure 1:
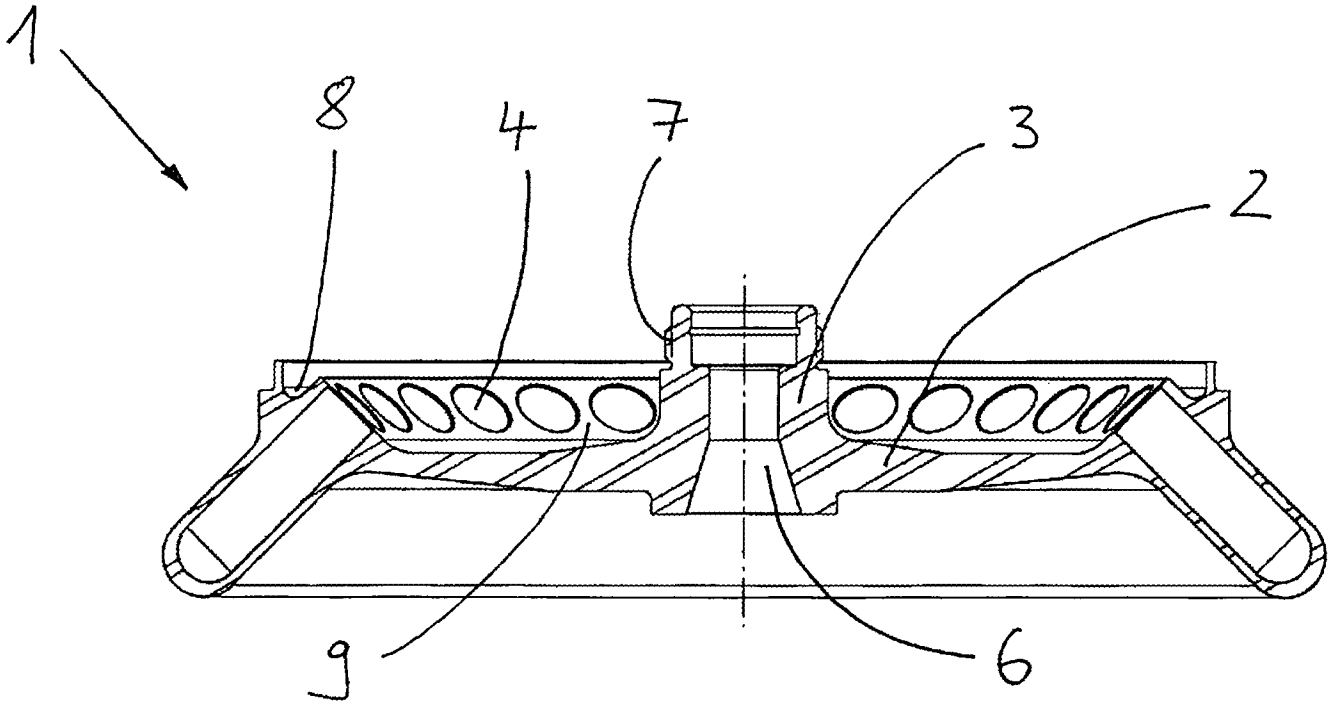
FIG. 1 illustrates a sectional view of a prior art centrifuge rotor.

FIG. 1 illustrates a known centrifuge rotor 1 including a rotor body 2 made of a solid metal, usually aluminum. Around a rotational axis the rotor body 2 includes a hub portion 3, and in radially outer portions receiving sections 4 for samples to be centrifuged are provided. The hub portion 3 includes tapped holes (not shown) for identifying the centrifuge rotor. Further, a receiving section 6 for arranging the centrifuge rotor 1 at the drive unit of a centrifuge is provided in the hub portion 3, and above the receiving sections 4 the hub portion 3 includes a thread 7 for non-positive connection of the centrifuge rotor 1 with a centrifuge lid not shown. This centrifuge lid can engage a recess 8 in a form locking and friction locking manner to seal the centrifuge space 9 in an aerosol-tight manner.

Figure 2:
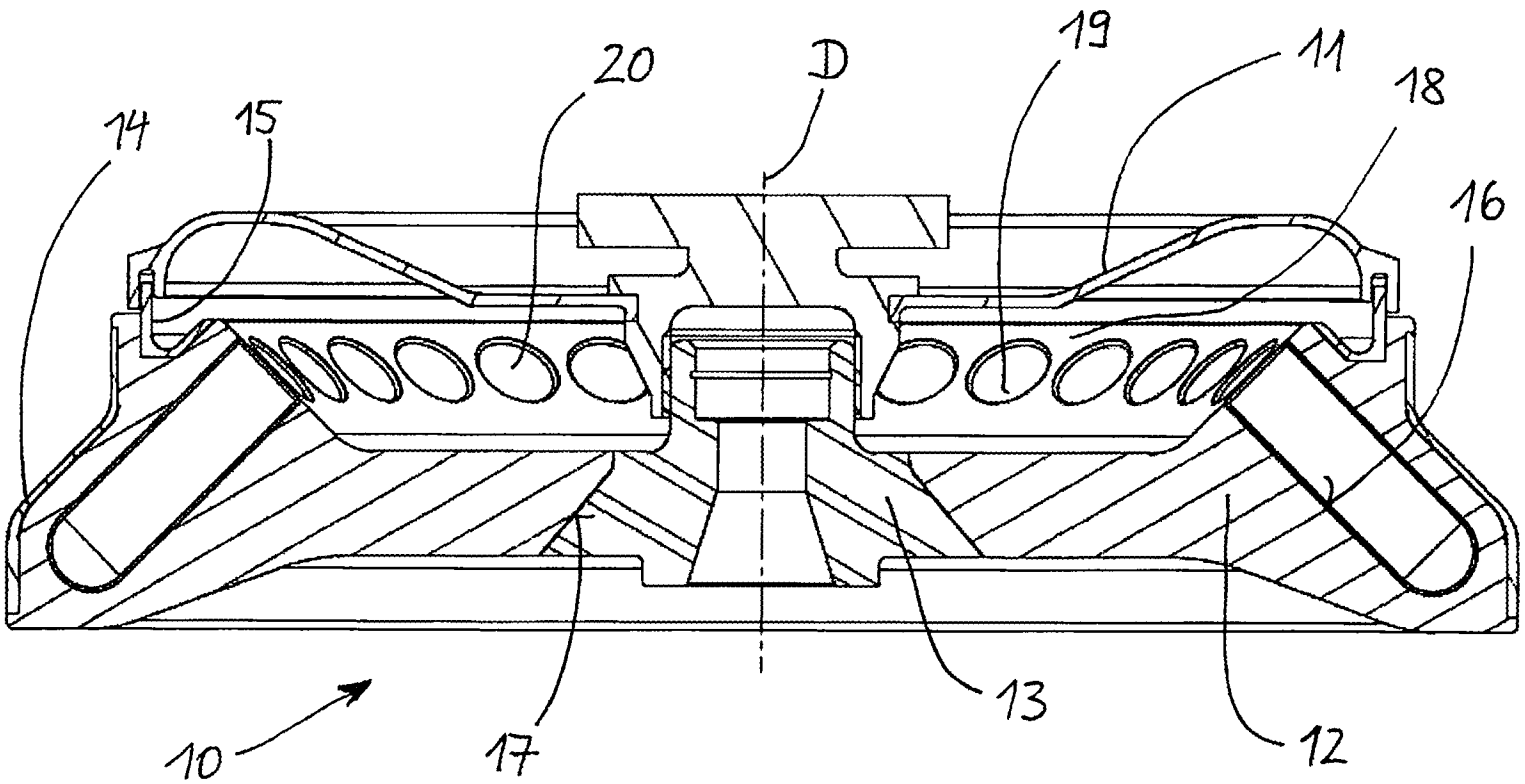
FIG. 2 illustrates a sectional view of a centrifuge rotor according to a first advantageous embodiment of the present invention interacting with a centrifuge lid.
Figure 3:
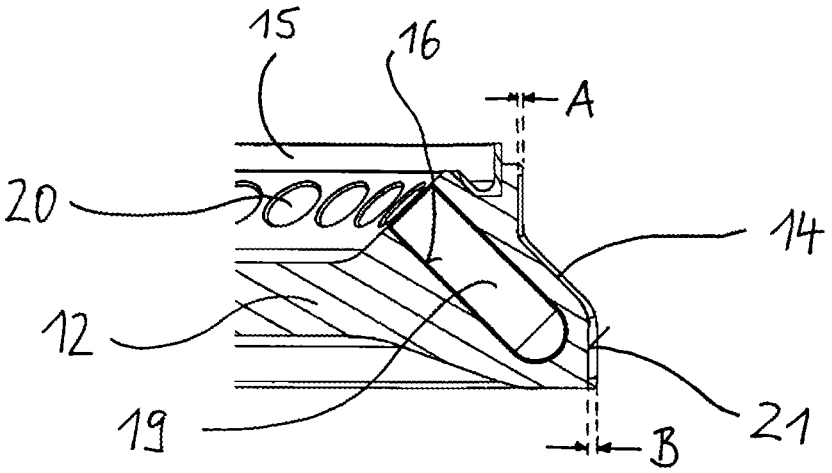
FIG. 3 illustrates a detail of the centrifuge rotor according to the present invention shown in FIG. 2.
Figure 4:
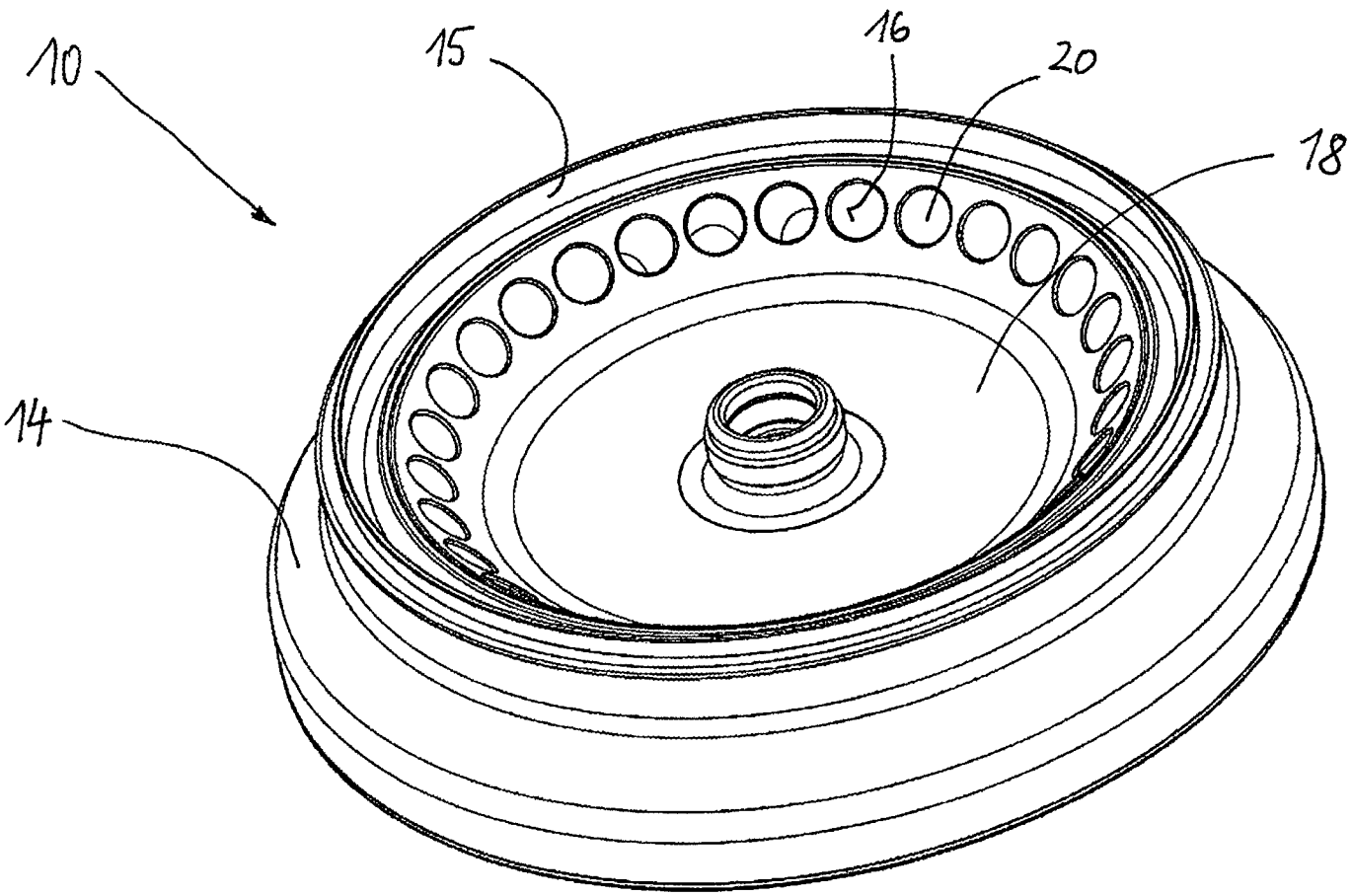
FIG. 4 illustrates a general view of the centrifuge rotor according to the present invention shown in FIG. 2.

FIGS. 2 to 4 schematically illustrate the centrifuge rotor 10 according to a first advantageous embodiment of the present invention, wherein FIG. 2 is a sectional view schematically illustrating the centrifuge rotor 10 according to the present invention interacting with a centrifuge lid 11. FIG. 3 illustrates a detail and FIG. 4 illustrates a perspective general view.

It can be seen that in contrast to the known centrifuge rotor 1 illustrated in FIG. 1, the centrifuge rotor 10 according to the present invention is of multi-part configuration. More precisely, the centrifuge rotor 10 including the rotational axis D includes a centrifuge body 12, a hub 13, an armoring 14, a contour ring 15 and sleeves 16.

The rotor body 12 is made of an aluminum foam which is produced e.g. by foaming a foaming mold with a gas-containing aluminum melt or by heating aluminum powder with gas formers in the foaming mold. When the rotor body subsequently cools, the melt solidifies and forms the aluminum foam. The rotor body 12 includes a medium pore size ranging from 230 μm to 270 μm, preferably of approximately 250 μm, such that the rotor body 12 on the one hand side has very low density and on the other hand side has a very high stiffness due to an advantageous adjustment of the pore size relative to the web thickness.

As can be seen when comparing FIG. 1 and FIG. 2, in contrast to the conventional centrifuge rotor 1, the centrifuge rotor 10 according to the present invention has a larger thickness to increase the stiffness at reduced weight.

The hub 13 made of aluminum as a solid material, i.e. not as foam, is screwed (not shown) into the rotor body 12 and comprises a tapered surface 17. This ensures a friction locking connection between hub 13 and rotor body 12. In addition, the hub 13 further includes tapped holes (not shown) for identifying the centrifuge rotor 10. Alternatively, the hub 13 can be directly foamed in place in the rotor body 12, wherein in this case the hub 13 must be made of an aluminum alloy having a sufficiently high melting point to prevent it from melting or softening when being foamed in place. Advantageously, the hub 13 includes form locking elements provided as anti-twist elements towards the rotor body 12, said form locking elements being provided as axially configured ribs or webs on the tapered surface 17.

Between centrifuge lid 11 and rotor body 12 a centrifuge space 18 is defined when the centrifuge rotor 10 is closed. In the rotor body 12 receiving sections 19 for samples to be centrifuged are milled. For sealing the pores of the aluminum foam opened by the milling process, the sleeves 16 are glued into the receiving sections 19. Moreover, the rotor body 12 is provided with a surface sealing of Teflon® (Teflon® is a registered Trademark of E.I. du Pont de Nemours and Company) or similar compounds resistant to temperature and chemicals, whereby open pores are effectively sealed.

Above and outside with respect to the openings 20 of the receiving sections 19 as seen in the radial direction, the contour ring 15 is arranged, preferably glued, in a recess of the rotor body 12. The contour ring 15 is preferably also made of an aluminum solid metal or any other metal having a higher strength than the rotor body 12 to minimize or suppress introduction of stress from the lid 11 into the rotor body 12.

As can in particular be seen in FIG. 3, the rotor body 12 includes a recess 21 disposed radially outside along its circumference, in which the armoring 14 is arranged, e.g. glued, whereby a bonded and form locking connection is created which is particularly reliable and durable. The radial depth of the recess 21 has a smaller extension A in sections located radially farther inside than the extension B in sections located radially farther outside. This results in special additional stiffening of the radially outer portions which are subjected to higher loads, whereby in every portion a sufficient armoring strength is ensured and thus weight can be saved.

The armoring is made of a hardened fiber-reinforced composite material including a carbon roving which is integrated in a cross-linked epoxy resin. For arranging the armoring 14 at the rotor body 12, advantageously a method is applied where both parts 12, 14 are available as manufactured with their final dimensions and the rotor body 12 is cryogenically shrunk to allow the armoring to be pulled over the rotor body. The thickness of the armoring 14 ranges between 0.1 to 5 mm, preferably 0.5 to 3 mm and is in particular 1 mm at the extension A and 1.5 mm at the extension B. The thickness of the armoring 14 is selected to be as small as possible such that on the one hand the mass is kept as small as possible and on the other hand the armoring allows a great deal of the forces in the rotor to be absorbed by the armoring 14 and the porous rotor body 12 to be relieved.

In this advantageous embodiment a tapered (conical) connection 17 is provided between hub 13 and rotor body 12, whereby an optimized support of the rotor body 12 is achieved with as little stress as possible being introduced.

Alternatively, other profiles may be used, such as stepped profiles, but the tapered connection offers the best properties possible.

Figure 5:
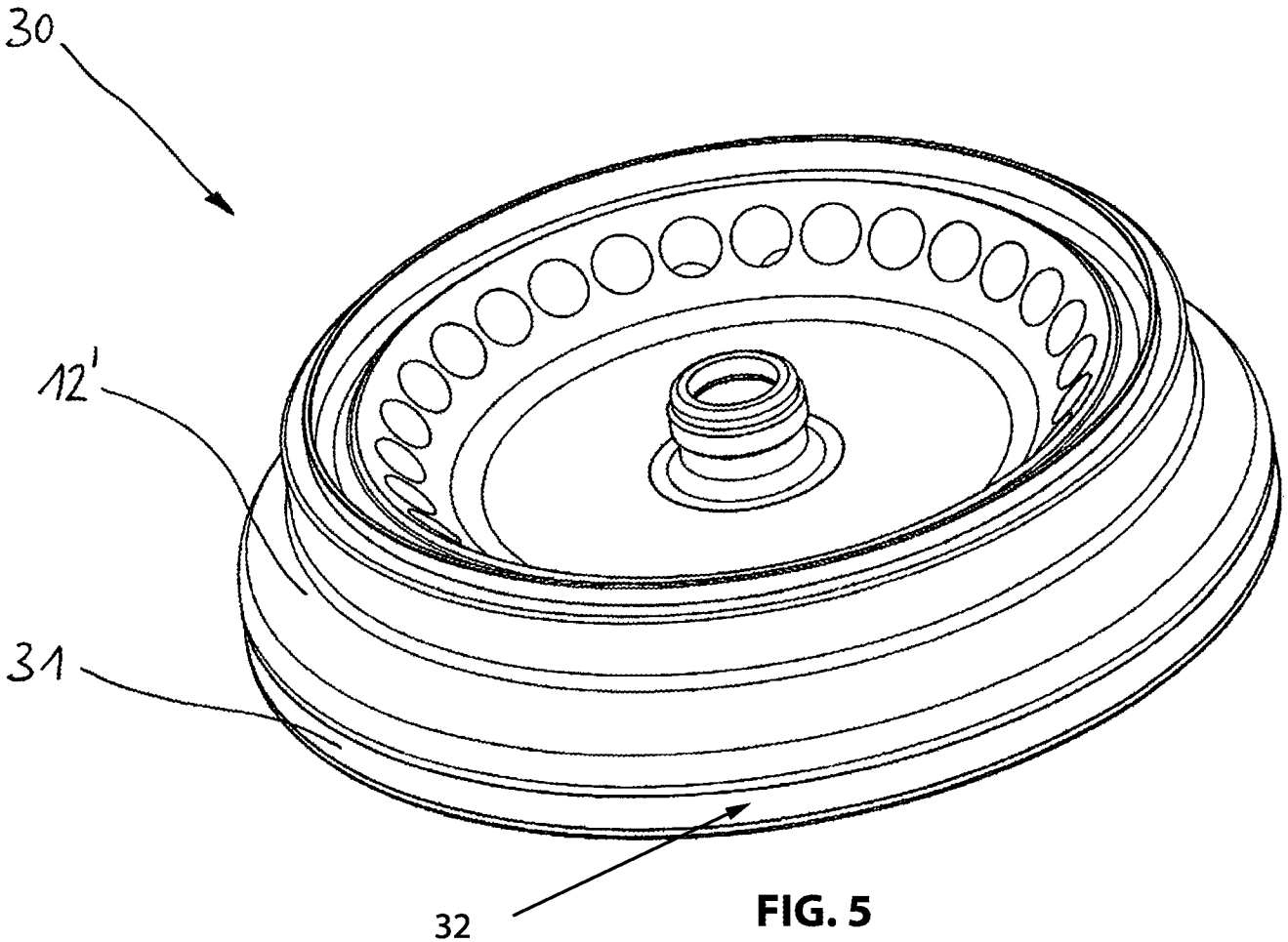
FIG. 5 illustrates a general view of a second advantageous embodiment of the centrifuge rotor according to the present invention.

FIG. 5 schematically illustrates a general view of a second advantageous embodiment of the centrifuge rotor 30 according to the present invention. The only difference in comparison to the centrifuge rotor 10 according to the present invention shown in FIGS. 2 to 4 is that here the armoring 31 is not essentially arranged over the overall circumference of the rotor body 12' but only in the portion located radially farthest outside, wherein only in this portion the corresponding recessed groove 32 for positive reception of the armoring 31 in the rotor body 12' is provided. In this case the armoring 31 is somewhat thicker, i.e. approximately 2.5 mm, but altogether the centrifuge rotor 30 has a somewhat lower weight.

It is an object of the present invention to make at least a portion of the rotor body 12 from a porous material, e.g. a metal foam, and to stiffen the rotor body 12 with an armoring 14, 31. In contrast, conventional centrifuge rotors 1 are made of metal or plastic material and have a considerably larger mass and a lower stiffness than the centrifuge rotor 10, 30 according to the present invention.

In table 1 the maximum stresses and deformations occurring in the centrifuge rotor 1 shown in FIG. 1 and the centrifuge rotor 10 according to the present invention shown in FIGS. 2 to 4 at rotational speeds of n=14,000 rpm are compared with each other. In the centrifuge rotor 10 according to the present invention the maximum stress of approximately 151 MPa occurs in the armoring 14. It is apparent that the armoring considerably reduces the deformation of the centrifuge rotor 10 (approximately 30%) and converts it into stresses with simultaneous stress relief of the remaining component parts of the centrifuge rotor.

TABLE 1

| | Stress (MPa) | Deformation (mm) |
|---|---|---|
| Centrifuge rotor 1 | 120 | 0.098 |
| Centrifuge rotor 10 | 151 | 0.069 |

In table 2 the tensile strengths of the components used of the centrifuge rotor 10 according to the present invention illustrated in FIGS. 2 to 4 are compared with the maximum stresses at rotational speeds of n=14,000 rpm, wherein the percentage values show the load acting on the respective material. It is apparent that due to the use of the armoring 14 the rotor body 12 of aluminum foam absorbs the occurring loads. Without the armoring 14 the tensile strength of the aluminum foam would be exceeded at very low rotational speeds and the rotor body would fail.

TABLE 2

| | Tensile strength | Max. stresses occurred | |
|---|---|---|---|
| Component/material | (MPa) | Value (MPa) | Value (%) |
| Rotor body 12<br>Aluminum foam<br>Cymat | 8.5 | 5.4 | 63.5 |
| Hub 13<br>Aluminum | 480 | 35 | 7.3 |
| Armoring 14<br>Carbon roving | 4300 | 151 | 3.5 |

Eventually, in Table 3 the overall masses of the conventional centrifuge rotor 1 are compared with those of the centrifuge rotor 10 according to the present invention illustrated in FIGS. 2 to 4. It is apparent that the centrifuge rotor 10 according to the present invention has an overall mass considerably reduced by approximately 36.5%.

TABLE 3

| | Overall mass (g) | Saving of mass (%) |
|---|---|---|
| Centrifuge rotor 1 | 848 | — |
| Centrifuge rotor 10 | 539 | approx. 36.5% |

Thus, due to the combined effect, the combination according to the invention offers numerous advantages. On the one hand, rotational speeds critical to the centrifuge rotor 10, 30 occur only in higher ranges than in the conventional centrifuge rotors 1. Thus centrifugation can be performed in a shorter time than before and at higher speed. This results in higher RCA values and thus in a very rapid separation of the constituents of the substances to be centrifuged. "RCA" is the relative centrifugal acceleration which is calculated according to the formula $RCA=4\ Pi^2 r\ n^2/g$ (r—radius of the centrifuge rotor, n—rotational speed, g—acceleration due to gravity) and is a measure of the efficiency of the centrifuge, wherein a higher value indicates a higher centrifugal acceleration in conjunction with a more efficient centrifugation of the sample.

Furthermore, the centrifuge rotor 10, 30 can more rapidly attain the required rotational speed since the mass moments of inertia are reduced by the reduction of the mass of the overall structure, and/or decelerated from said rotational speed to standstill. Moreover, the energy required for centrifugation is considerably reduced since lower forces are required for acceleration purposes. In addition, pollution emissions are decreased due to better vibration-damping properties of the porous material, whereby less vibrations than previously occur in the surroundings and altogether the service life of the centrifuge (not shown) is increased.

Further, it is less probable that damages occur due to fatigue fracture or the like since the porous material suppresses cracking. Damage due to destruction of a centrifuge rotor 10, 30 results in the kinetic energy of the parts of the destroyed rotor body 12 being smaller because of the smaller mass of the porous material, which allows the corresponding protection devices to be configured in smaller dimensions. In this regard, it is also of importance that porous materials, in particular metal foams, have proven successful as crash absorbers especially in the automobile industry. In the case of failure, the porous material can absorb the kinetic energy and convert it into deformation. This provides an additional safety aspect.

Finally, handling of the rotor body 12 is considerably more user-friendly because of the smaller mass.

Due to the high strength properties of the armoring 14, 31 the load applied by stresses to the rotor body 12 is decreased, the stiffness of the overall centrifuge rotor 10, 30 is increased and the mass of the centrifuge rotor 10, 30 is only slightly affected.

From the above description it is apparent that the centrifuge rotor 10, 30 according to the present invention allows for a considerably more efficient and reliable centrifugation and offers significant advantages with regard to user friendliness.

What is claimed is:

1. A centrifuge rotor, comprising:

a circular one piece rotor body at least partially including a porous metal or a porous metal alloy; and at least one armoring that is arranged at the circular one piece rotor body on a radial outside of the circular one piece rotor body with reference to a rotation axis of the circular one piece rotor body, wherein the centrifuge rotor includes a hub arranged at the rotor body, wherein the hub is fixated in the rotor body through annular foam encasement, wherein the foam forms an annular region around an entire circumference of the hub, and wherein the annular region extends over an entire axial extension of the hub.

2. The centrifuge rotor according to claim 1, wherein the porous metal or the porous metal alloy is a foam material.

3. The centrifuge rotor according to claim 1, wherein the metal or the metal alloy includes at least one component selected from the group of aluminum, iron, copper, magnesium, nickel, titanium or alloys thereof or brass.

4. The centrifuge rotor according to claim 1, wherein the armoring includes a fiber-reinforced plastic material.

5. The centrifuge rotor according to claim 1, wherein the armoring is arranged in a recess provided in the rotor body, wherein the armoring has a larger radial width at least in a portion of the rotor body located radially farther outside than in a portion of the rotor body located radially farther inside, wherein the centrifuge rotor includes a hub arranged at the rotor body, wherein the hub is fixated in the rotor body through annular foam encasement, wherein the foam forms an annular region around an entire circumference of the hub, and wherein the annular region extends over an entire axial extension of the hub.

6. The centrifuge rotor according to claim 1, wherein the porous metal or the porous metal alloy has a medium pore size of 10 μm to 500 μm, and wherein the pores are sealed.

7. The centrifuge rotor according to claim 1, wherein the armoring essentially completely encloses a circumference of the rotor body.

8. The centrifuge rotor according to claim 1, wherein a contour ring for a form locking connection with a centrifuge lid is arranged at the rotor body, and wherein the contour ring is configured as a separate element having a higher strength than the porous metal or the porous metal alloy.

9. The centrifuge rotor according to claim 1, wherein the armoring includes a fiber-reinforced material, wherein the fibers include at least one material selected from the group of carbon fibers, mineral fibers, ceramic fibers or plastic fibers or mixtures thereof, and wherein the armoring includes a fiber-reinforced plastic material.

10. The centrifuge rotor according to claim 1, wherein the armoring is arranged in a recess provided in the rotor body, and wherein the armoring has a larger radial width at least in a portion of the rotor body located radially farther outside than in a portion of the rotor body located radially farther inside.

11. The centrifuge rotor according to claim 1, wherein the armoring is arranged in a groove provided in the rotor body, or wherein the armoring has a larger radial width at least in a portion of the rotor body located radially farther outside than in a portion of the rotor body located radially farther inside.

12. The centrifuge rotor according to claim 1, wherein the armoring is arranged in a groove provided in the rotor body, and wherein the armoring has a larger radial width at least in a portion of the rotor body located radially farther outside than in a portion of the rotor body located radially farther inside.

13. The centrifuge rotor according to claim 1, wherein the centrifuge rotor includes a hub arranged at the rotor body, and wherein the hub includes a non-porous metal or a non-porous metal alloy.

14. The centrifuge rotor according to claim 1, wherein the hub is foamed in place in the rotor body, and wherein the hub is detachably fastened to the rotor body.

15. The centrifuge rotor according to claim 6, wherein the porous metal or the porous metal alloy has a medium pore size of 100 μm to 500 μm.

16. The centrifuge rotor according to claim 6, wherein the porous metal or the porous metal alloy has a medium pore size of 250 μm.

17. The centrifuge rotor according to claim 1, wherein the hub is of a conical configuration.

18. The centrifuge rotor according to claim 1, further comprising a contour ring made from a metal having a higher strength than the rotor body.

* * * * *